US005634692A

United States Patent [19]

Kaneko et al.

[11] Patent Number: 5,634,692

[45] Date of Patent: Jun. 3, 1997

[54] MAIN-ANCILLARY TUNNEL EXCAVATOR

[75] Inventors: Kenichi Kaneko; Toshihiko Bessho, both of Tokyo; Yoshihiro Uchiyama, Kobe; Toshihumi Inoue, Kobe; Masahiko Sugiyama, Kobe, all of Japan

[73] Assignees: Taisei Corporation; Mitsubishi Jukogyo Kabushiki Kaisha, both of Tokyo, Japan

[21] Appl. No.: 525,458

[22] Filed: Sep. 6, 1995

[30] Foreign Application Priority Data

| | | | |
|---|---|---|---|
| Sep. 9, 1994 | [JP] | Japan | 6-242115 |
| Dec. 20, 1994 | [JP] | Japan | 6-316196 |
| Jun. 2, 1995 | [JP] | Japan | 7-159801 |

[51] Int. Cl.[6] ..... F21D 9/06

[52] U.S. Cl. ..... 299/33

[58] Field of Search ..... 299/33, 58, 59; 175/77, 95, 96, 97, 98, 99

[56] References Cited

U.S. PATENT DOCUMENTS 5,051,032 9/1991 Bessho et al. .

FOREIGN PATENT DOCUMENTS

| | | |
|---|---|---|
| 0432901 | 7/1994 | European Pat. Off. . |
| 69010862 | 11/1994 | Germany . |
| 2036970 | 1/1989 | Japan . |
| 1981694 | 2/1989 | Japan . |

OTHER PUBLICATIONS

Exhibit 1, copy of photograph of tunnel–boring machine, date unknown.

Sterling, Underground Research: Here And There, Civil Engineering, Dec. 1992.

Itoh et al, Development of Vertical–Horizontal Shield Machine, Tunneling and Ground Conditions, 1994.

*Primary Examiner*—William P. Neuder

*Attorney, Agent, or Firm*—Nikaido, Marmelstein, Murray & Oram LLP

[57] ABSTRACT

A turnable tunnel excavator and tunneling method are provided which can alternate between construction of a main tunnel A and crosscuts B, and can excavate other tunnels without having to pass through an arc. It is comprised of a main machine and an ancillary machine housed inside a pivotable housing within the said main machine and how to operate such a machine.

15 Claims, 10 Drawing Sheets

MAIN-ANCILLARY TUNNEL EXCAVATOR

This invention relates to a main-ancillary tunnel excavator and a method of tunneling using the same.

In garbage treatment facilities, quarries, or similar facilities, it is often the case that one main tunnel is excavated and a series of crosscuts are dug on both sides at right angles to the central spine or main tunnel thereby forming a centipede-like configuration. As shown in FIG. 9, conventionally, two excavators are used; a large-scale excavator to dig the main tunnel A and a small-scale excavator to dig, the crosscuts B.

The main tunnel A is completely excavated first, after which concrete is sprayed on the wall surfaces. Then a small excavator is brought in, and a reaction force device C, to receive the reaction forces, is set on the wall opposite to the wall from which crosscut B is to be dug. Excavation of the shaft B proceeds as the small excavator takes the reaction forces at equipment C.

The conventional excavation method as described presents the following problems.

1. Two excavators, one large and one small, are required.
2. The reaction force device must be moved and positioned on the opposite wall for each crosscut, involving time and financial cost.
3. The small excavator must be moved for each crosscut.
4. The small excavator must be lifted to a prescribed height for each launch to excavate a crosscut.
5. Concrete sprayed temporarily for construction of the main tunnel must be crushed to launch the small excavator for the crosscut.

OBJECTS AND SUMMARY OF THE INVENTION

It is an object of this invention to resolve the conventional problems as described and more specifically, to provide a main-ancillary tunnel excavator and a tunneling method that can alternately excavate the main tunnel and the ancillary tunnels.

Another object of the invention is to provide a main-ancillary tunnel excavator and tunneling method that can excavate the crosscuts without having to use a special reaction force device.

A further object of the invention is to provide a main-ancillary tunnel excavator and tunneling method that can, at any time while excavating the main tunnel, make a 90 degree turn to excavate any crosscut, without having to travel through an arc.

A still further object of the invention is to provide a main-ancillary tunnel excavator and tunneling method that can quickly and safely switch or alternate between the excavation of the main tunnel and excavation of the ancillary tunnel.

A separate object of the invention is to provide a main-ancillary tunnel excavator in which notches are formed on the outer cutting ring and inner cutting disc to facilitate transmission of the torque and to facilitate separation of the two cutting units.

A further separate object of the invention is to position roller cutters or bits over the entire cutter surface.

To achieve the above objectives, this invention is a novel main-ancillary tunnel excavator comprising a main machine configured from a front cylinder and rear cylinder, a propulsion jack connecting the said cylinders, and grippers which take the reaction forces at the excavated walls; a pivotable housing which turns inside the said main machine; and an ancillary machine housed inside the said pivotable housing and configured from a front cylinder and rear cylinder, a propulsion jack connecting the said cylinders, and grippers which take the reaction forces at the excavated walls.

As well, the main-ancillary tunnel excavator can be comprised of a main machine configured from an inner cutting disc and an outer cutting ring surrounding the said disc, and an ancillary machine which serves a dual function as the said inner cutting disc, wherein notches on the inner perimeter of the outer cutting ring and on the outer perimeter of the inner cutting disc mesh the two surfaces together such that the two cutting units cannot mutually rotate, but are detachable.

In addition, the present invention includes a method of tunneling comprising certain specific steps. A main tunnel is excavated with a main tunnel excavator including a front cylinder, a rear cylinder, a propulsion jack connecting said front and rear cylinders, and grippers which take the reaction force at the excavated walls while said tunnel excavator is excavating. A pivotable housing is provided and is turnably mounted in the main tunnel excavator. An ancillary tunnel excavator is removably housed inside the pivotable housing and includes an ancillary front cylinder, an ancillary rear cylinder, an ancillary propulsion jack connecting the front cylinder and the ancillary rear cylinder, and ancillary grippers mounted on the ancillary front cylinder and the ancillary rear cylinder which take the reaction forces at the walls excavated by the ancillary tunnel excavator while the ancillary tunnel excavator is excavating. At a position along the main tunnel where a crosscut is desired, the pivotable housing is turned to face the position and the crosscut is excavated with the ancillary tunnel excavator.

The method of excavating can further comprise, that after excavation of the crosscut, the ancillary tunnel excavator is returned into the pivotable housing in the main tunnel excavator, the pivotable housing is turned directly away from the position, and another crosscut is excavated with the ancillary tunnel excavator.

Additionally, the method of excavating can further comprise that after excavation of the crosscut, the ancillary tunnel excavator is returned into said pivotable housing in said main tunnel excavator, the pivotable housing is turned directly away from the position, the main tunnel is further excavated with the main tunnel excavator, at a second position along the main tunnel where another crosscut is desired, the pivotable housing is turned to face the second position, and a further crosscut is excavated with the ancillary tunnel excavator.

As an alternative method of tunneling the present invention can comprise the following specific steps. A main tunnel excavator is provided including a front cylinder, a rear cylinder, a propulsion jack connecting the front and rear cylinders, an inner cutting disc and outer cutting ring surrounding the disk positioned on a front face of the excavator, a pivotable housing which turns inside the main excavator, and grippers which take the reaction force at the excavated walls while the tunnel excavator is excavating. The main tunnel is excavated with the outer cutting ring and the inner cutting disc. An ancillary tunnel excavator is removably housed inside the pivotable housing, the ancillary tunnel excavator including an ancillary front cylinder, an ancillary rear cylinder, an ancillary propulsion jack connecting the ancillary front cylinder and the ancillary rear cylinder, and ancillary grippers mounted on the ancillary front cylinder and the ancillary rear cylinder which take the reaction forces at the walls excavated by the ancillary tunnel excavator while the ancillary tunnel excavator is excavating, the inner cutting disc of the main tunnel excavator serving as the cutting disc of the ancillary tunnel excavator. At a position along the main tunnel where a crosscut is desired, the pivotable housing is turned to face the position and the crosscut is excavated with the inner cutting disc serving as the cutting disc of the ancillary tunnel excavator.

The method of excavating can further comprise, that after excavation of the crosscut, the ancillary tunnel excavator is returned into the pivotable housing in the main tunnel excavator, the pivotable housing is turned directly away from the position, and another crosscut is excavated with the inner cutting disc serving as the cutting disc of the ancillary tunnel excavator.

Additionally, the method of excavating can further comprise, that after excavation of the crosscut, the ancillary tunnel excavator is returned into the pivotable housing in the main tunnel excavator, the pivotable housing is turned in line with an axis of the main tunnel excavator, the main tunnel is further excavated with the outer cutting ring of the main tunnel excavator and the inner cutting disc, at a second position along the main tunnel where another crosscut is desired, the pivotable housing is turned to face the second position, and yet another crosscut is excavated with the ancillary tunnel excavator.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Working examples of the main-ancillary tunnel excavator of this invention are explained below, with reference to the diagrams.

In general, the tunnel excavator is a device structured from a cylindrical body split into a forward and rear section which takers the reaction force at the walls of the excavated tunnel and moves like an inchworm. Because of this movement, unlike a shield excavator which takes the reaction force at the rear segment this tunnel excavator is not limited to forward movement, and can reverse as well. A main-ancillary tunnel excavator as used in this application, is a tunnel excavator equipped with a main tunnel excavator and an ancillary tunnel excavator.

The main tunnel excavator I that forms a part of this invention (hereafter referred to as main machine) is a cylindrical body split into a forward and rear section. That is, it is comprised of a forward cylinder 11 and rear cylinder 12, connected by a propulsion jack 13 between the two sections.

Figure 1:
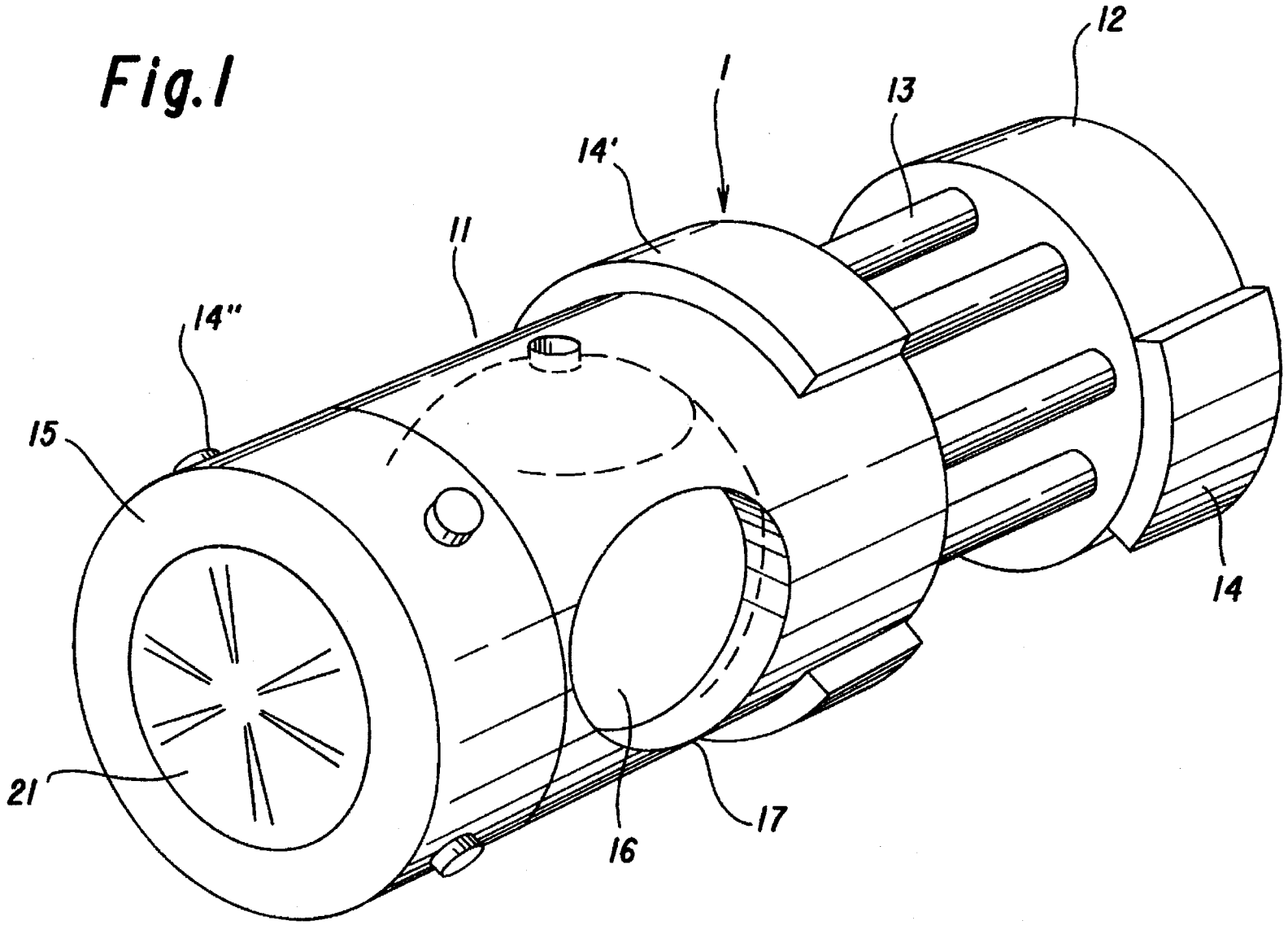
FIG. 1 is a perspective view of the main-ancillary tunnel excavator in the state to excavate the main tunnel according to the present invention.
Figure 2:
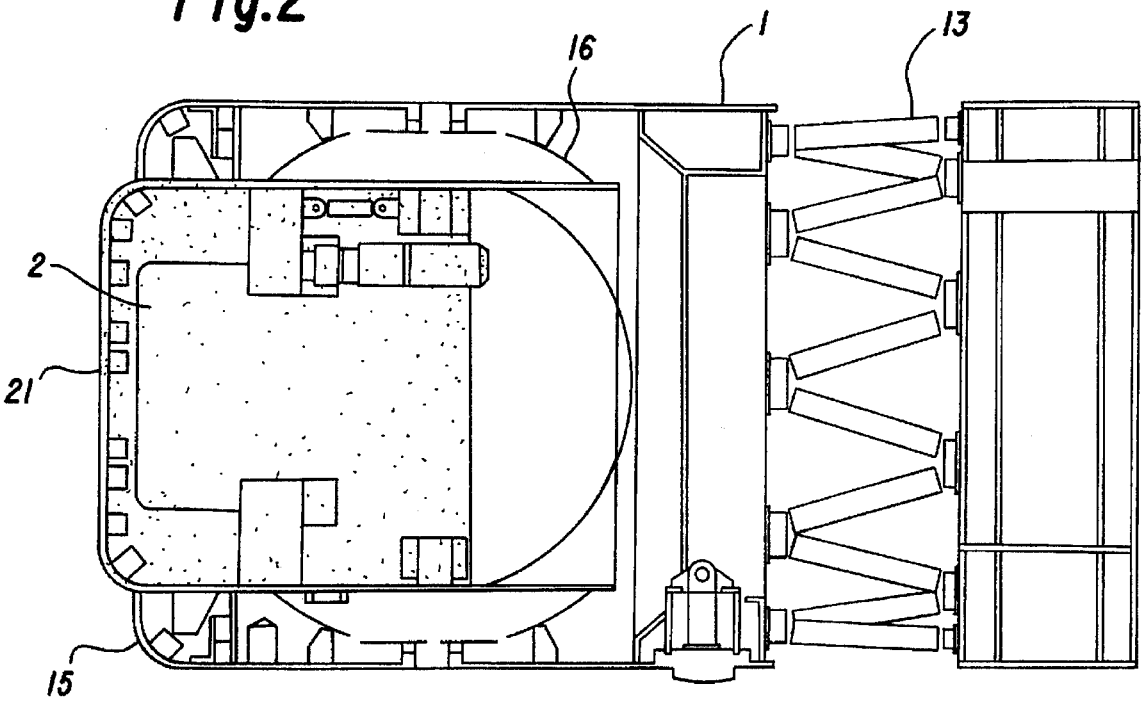
FIG. 2 is a side cross section view of the main-ancillary tunnel excavator.

Three gripper devices 14, 14', 14" are set on the forward and rear cylinders 11, 12 to take the reaction force at the excavated walls. These gripper devices, on the exterior surface of the cylindrical body, are shades as projecting arcs, or as short pegs, and are movable in the radial direction of the cylinder by jack set inside the excavator. FIG. 1 shows the grippers 14', 14" set at the front and rear of the front cylinder 11 with gripper 14 set on the rear cylinder 12.

A round cutting disc, divided into a core section and rim section, is set on the front face of the main machine 1. That is, an inner cutting disc 21 forms the core, and an outer cutting ring 15 is positioned around the perimeter of the inner cutting disc 21.

The inner cutting disc 21 serves a dual purpose. First, it is the core section of the cutting disc of the main machine and second, it is the cutting disc on the front face of the ancillary machine 2 (hereafter referred to as ancillary machine), to be described below, which is of smaller diameter than the main machine.

The outer cutting ring 15 is mounted on the main machine, and is detachable from the inner cutting disc 21. During excavation, keys are inserted to integrate the two units, such that the torque of the motor can be transmitted to both units.

A pivotable housing 16 is set inside the main machine 1. The pivotable housing 16 is a turnable, unit in which the central axis is vertical. The inner diameter is virtually equal to the outer diameter of the ancillary machine 2 to be described later. This configuration enables the ancillary machine 2 to be encased in the pivotable housing 16.

The pivotable housing 16, set within the main machine 1, can turn 90 degrees left or right of the direction of advancement of the main machine. For this, ports 17 of the same diameter as the pivotable housing 16 are opened on the side faces of the main machine 1.

The pivotable housing 16 can be spherical, cylindrical, polygonal, or any other shape.

The ancillary machine 2 is also a cutting device comprising a cylindrical body, divided into forward and rear sections, an ancillary machine propulsion jack connecting the two sections, and ancillary machine grippers 22 that take the reaction forces at the excavated walls. As described previously, the outer diameter of the ancillary machine is virtually equal to the inner diameter of the pivotable housing 16, within which it can be encased.

Grooves into which the ancillary machine grippers 22 interlock are bored inside said pivotable housing 16. This enables the main machine and ancillary machine to be securely locked into an integral unit. Hence, when the ancillary machine 2 is launched from the main machine 1, it takes the reaction force of the launch through the ancillary machine grippers 22.

The cutting disc 21 is set on the front face of the ancillary machine 2, which serves a dual purpose as the inner cutting disc of the main machine 1. As described previously, on the front face of the main machine 1, an outer cutting ring 15 is mounted around its perimeter, and the core is open. The inner cutting disc 21 of the ancillary machine 2 is interlocked inside the open core when excavating with the main machine 1.

The action of the device of this embodiment is explained below.

Main tunnel A (vertical, horizontal, or diagonal) is excavated first. For this, the cylindrical axis of the pivotable housing 16 is positioned in the direction of excavation, then ancillary machine 2, housed inside the pivotable housing, is advanced out of the housing. The outer cutting ring 15 is mounted on the perimeter of the front face of main machine 1 while the core is open, into which the inner cutting disc 21 of ancillary machine 2 can be interlocked. The main machine 1 and ancillary machine 2 are secured into an integral unit by means of keys. Next, the inner cutting disc 21 is rotated by the drive source 32 set inside the ancillary machine 2. As the inner cutting disc 21 and therefore the outer cutting ring 15 rotate, the cut rock is propelled to the rear of the main machine I and dispelled.

Excavation with the main machine I is terminated when it reaches the position where a crosscut B is to be dug. At this point, the ancillary machine 2 is reversed to be encased inside the pivotable housing 16. The pivotable housing 16 is then turned 90 degrees to shift the direction of the ancillary machine 2 by 90 degrees. Next, the ancillary machine grippers 22 on the rear section are interlocked into grooves of the pivotable housing 16, and the front section is advanced forward while rotating the cutting disc 21.

Figure 3:
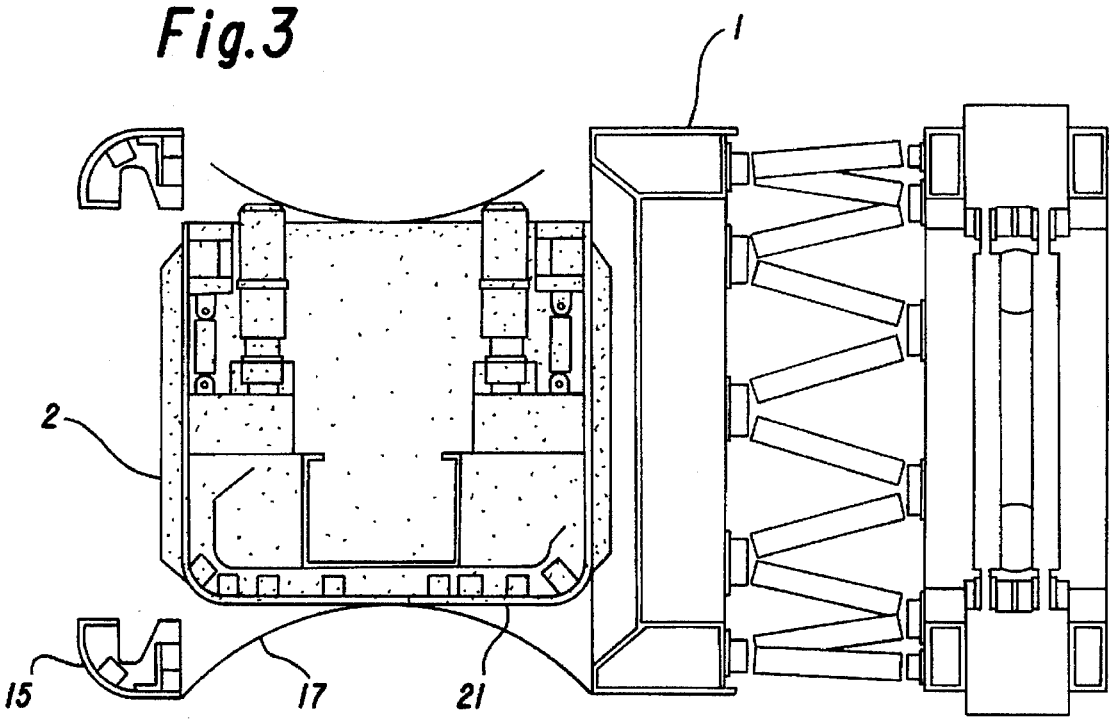
FIG. 3 is a cross section view of the main-ancillary tunnel excavator in which the ancillary machine has changed direction.
Figure 4:
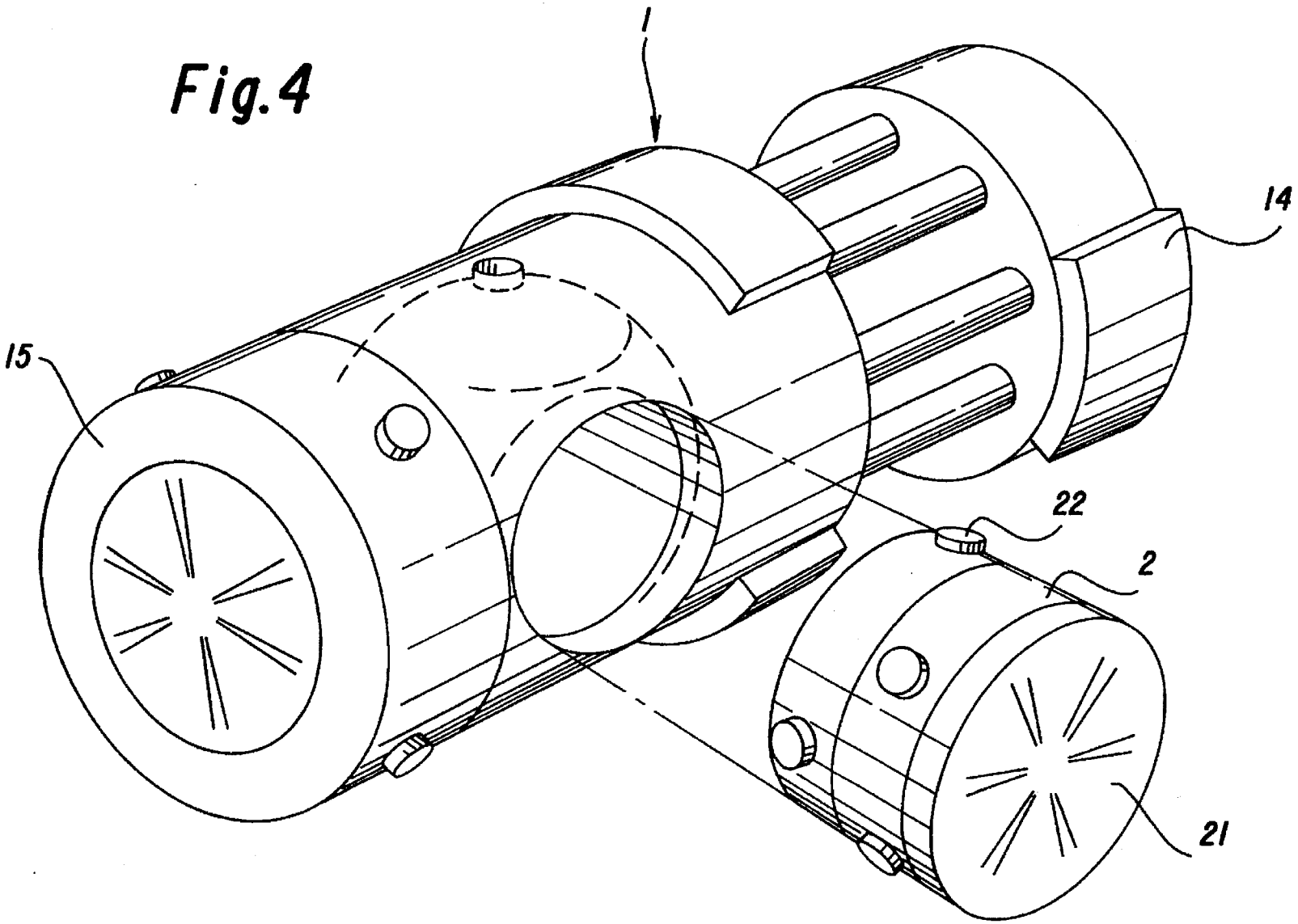
FIG. 4 is an explanatory perspective view of the main-ancillary tunnel excavator in which the ancillary machine has been launched.

As a result, the front section of the ancillary machine 2, while cutting into the side wall of the main tunnel A, becomes exposed out of the side face of the main machine I (FIG. 3 and FIG. 4). When the front section is exposed out of the housing, the grippers 22 of the front section of the ancillary machine 2 are exposed on the circumference, while the grippers 22 of the rear section are encased in the housing, the jack 23 between the two sections is shortened. As a result, the ancillary machine 2 is drawn out of the main machine 1. That is, as the ancillary machine 2 is launched, the reaction force of that launching is transmitted, in order, to the pivotable housing 16, the pivoting shaft of the pivotable housing, and the main machine 1, which eliminates the need for a separate reaction force device.

Figure 5:
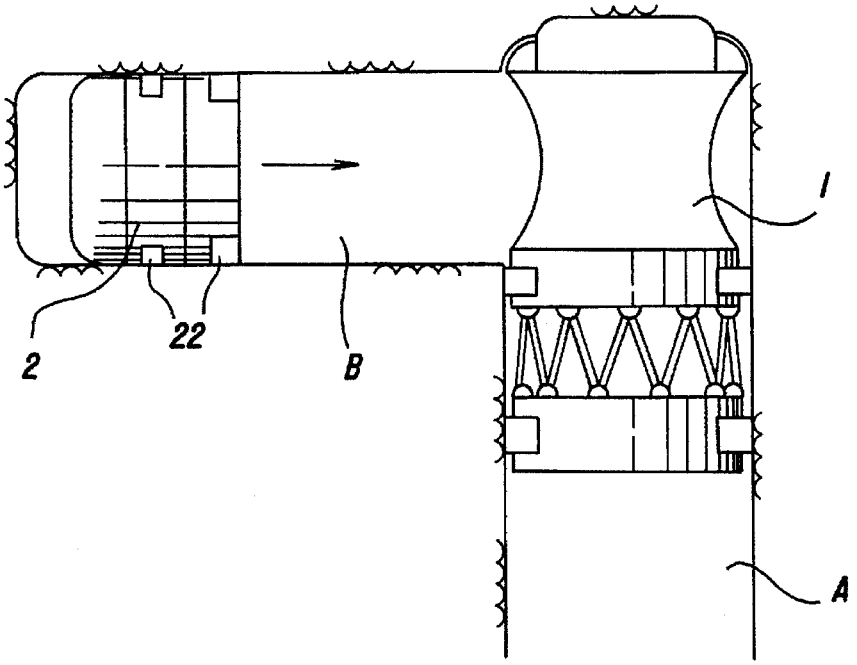
FIG. 5 is an explanatory diagram of the ancillary machine being returned from a crosscut.
Figure 6:
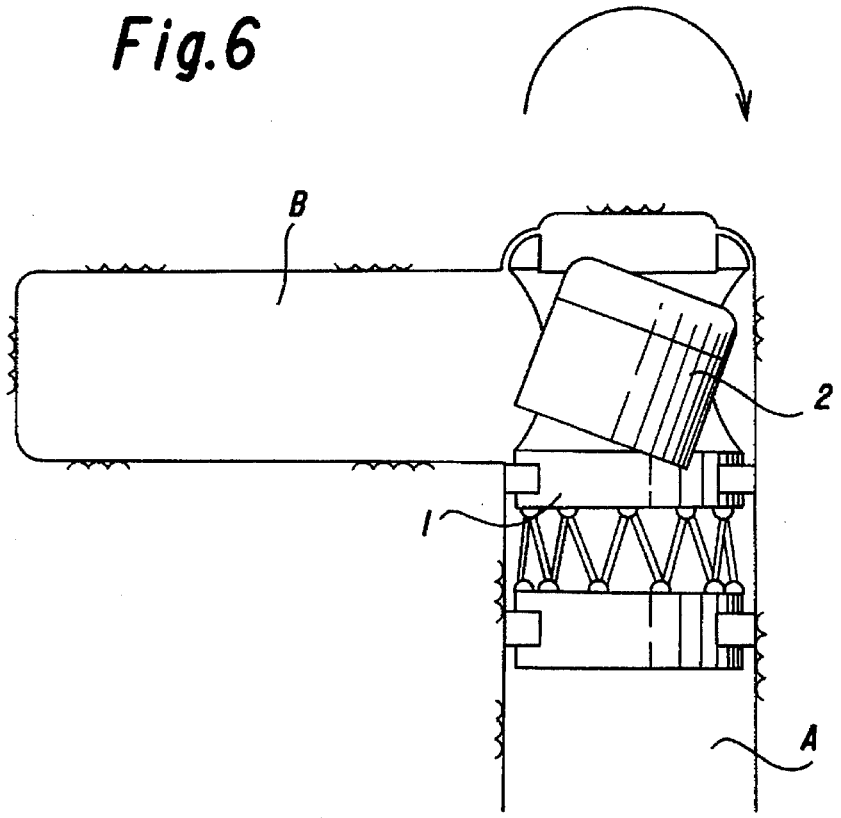
FIG. 6 is an explanatory diagram of the ancillary machine being turned into position.
Figure 7:
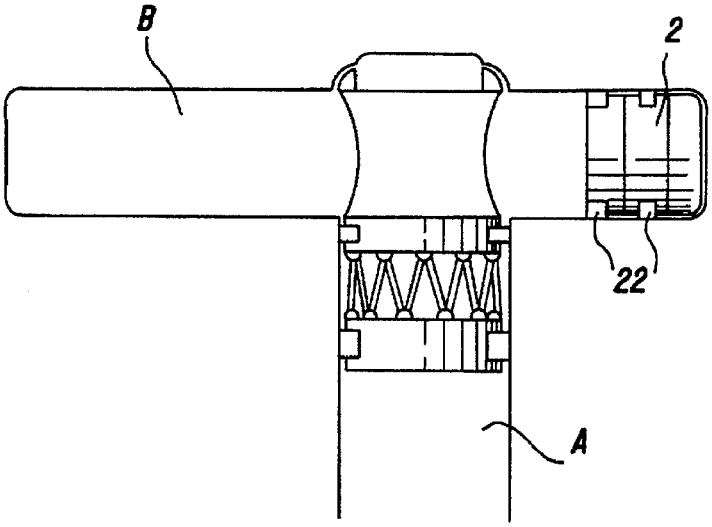
FIG. 7 is an explanatory diagram of a new crosscut being excavated.

In order to excavate crosscuts B branching out from both sides of the main tunnel A, the ancillary machine 2 must then be re-inserted inside the main machine 1. In this case, since the ancillary machine 2, like the main machine 1, takes the reaction forces at the peripheral walls and moves like an inchworm, it can reverse cut of the completed crosscut B, and once again return into the pivotable housing 16 of the main machine 1. (FIG. 5 Once the ancillary machine 2 is fully inside the main machine 1, the pivotable housing 16 is turned 180 degrees (FIG. 6). Then, in the same manner as previously, the ancillary machine 2 is launched cut of the cylindrical housing (FIG. 7), at which point, it is ready to excavate the crosscut B on the opposite side.

Figure 8:
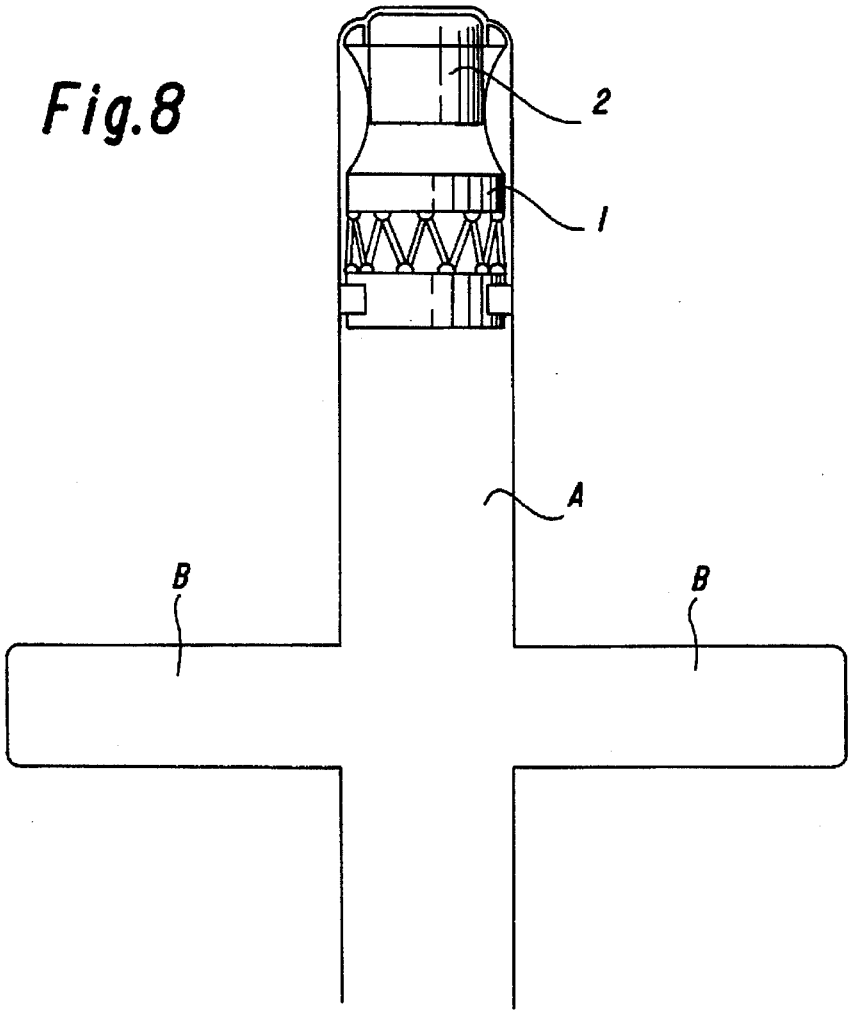
FIG. 8 is an explanatory diagram of the excavation of the main tunnel.

Next, when excavation of crosscut B is completed, the ancillary machine 2 is once again returned inside the main machine 1, then turned 90 degrees to match the direction of advancement of the main machine 1. There, it is advanced forward and set into the position to serve as the inner cutting disc, and re-starts excavation of main tunnel A. (FIG. 8).

If it is not necessary to excavate crosscuts B on both sides of the main tunnel A in the form of a centipede; crosscuts B can be excavated on one side of the main tunnel A only in the form of a comb.

In the method just explained, the ancillary machine 2 is reversed upon completion of an ancillary shaft, and once again returned inside the main machine 1. However, the ancillary machine 2 need not be returned, and can be advanced forward to excavate a separate tunnel.

This enables, for example, a T-shaped tunnel, to be excavated in which the direction of excavation can be turned 90 degrees from any point along the main tunnel without going through an arc, and makes for very economical operation.

Next, a different configuration or second embodiment of the main-ancillary tunnel excavator is explained.

Figure 10:
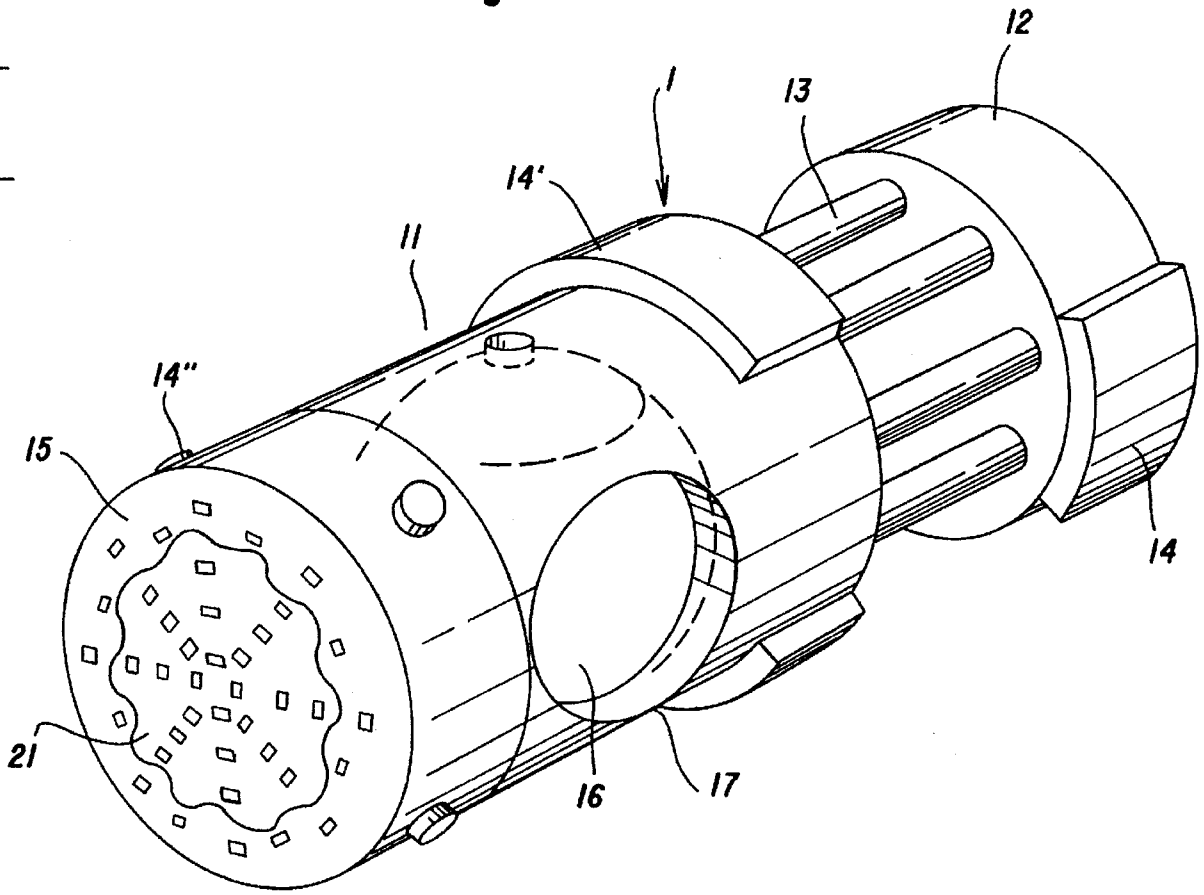
FIG. 10 is an overview diagram of the excavation of the main tunnel by a shape-modified main-ancillary tunnel excavator.
Figure 9:
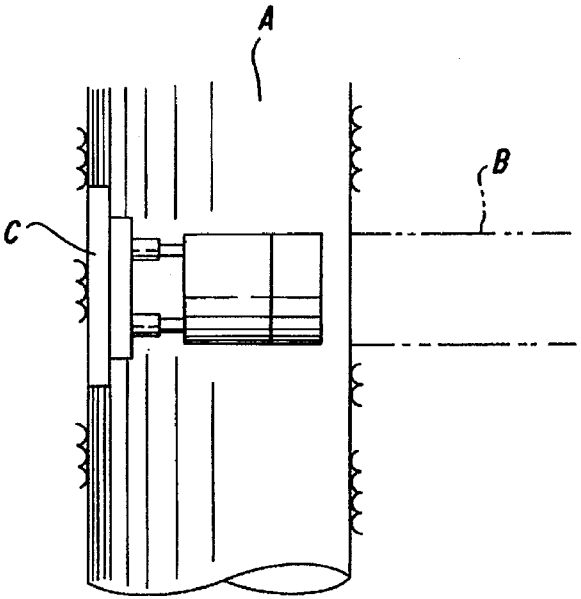
FIG. 9 is an explanatory diagram of the conventional method for excavation of a crosscut.
Figure 11:
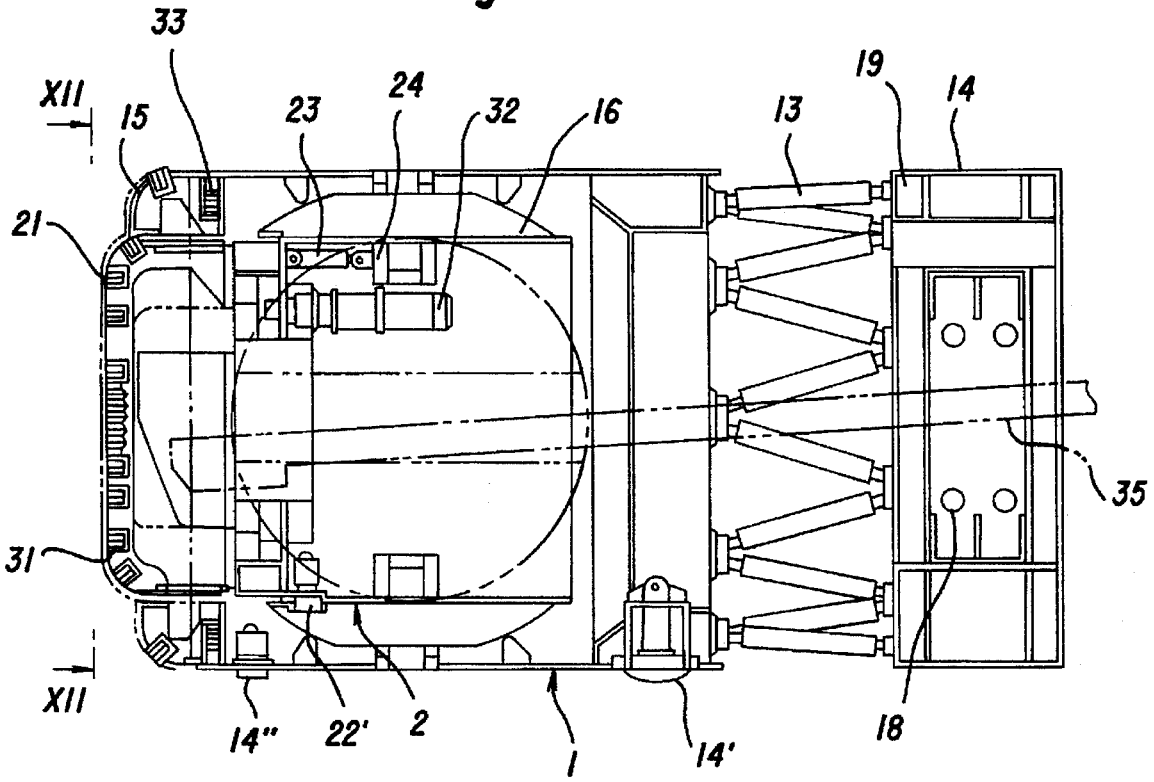
FIG. 11 is a side cross section diagram of the main machine.
Figure 12:
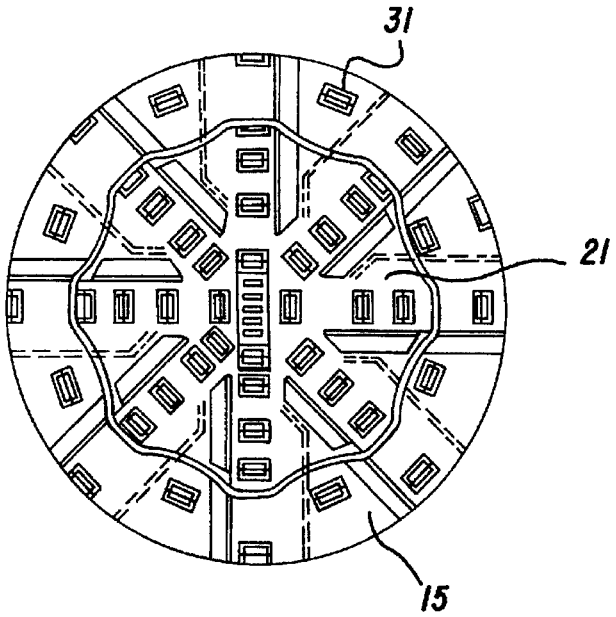
FIG. 12 is a cross section diagram of that portion of FIG. 11 between arrows XII—XII.

In this configuration, the outer cutting ring 15 is attacked by bearings 33 to the main machine 1. The outer rim of the inner cutting disc 21, supported to be adjustable and rotatable on the ancillary machine 2, is meshed to the inner rim of the cutting ring, suck that the two cutting units cannot mutually rotate and are detachable in the longitudinal direction. A drive source 32 mounted in the ancillary machine 2 drives the inner cutting disc 21, and its torque is transmitted to the outer cutting ring 15, wherein the ground is cut by the roller cutters 31 to excavate the tunnel. (FIG. 10–12).

In this case, the reaction forces, received by the rear gripper shoe 19, rear gripper 14, and rear gripper jack 18, are used and the main machine 1 advances forward with the extension of the propulsion jack 13. The excavated earth is discharged to the rear of the main machine I by the conveyor belt 35. Note that throughout the diagrams, 14' is the center gripper, and 14" is the front gripper.

Figure 13:
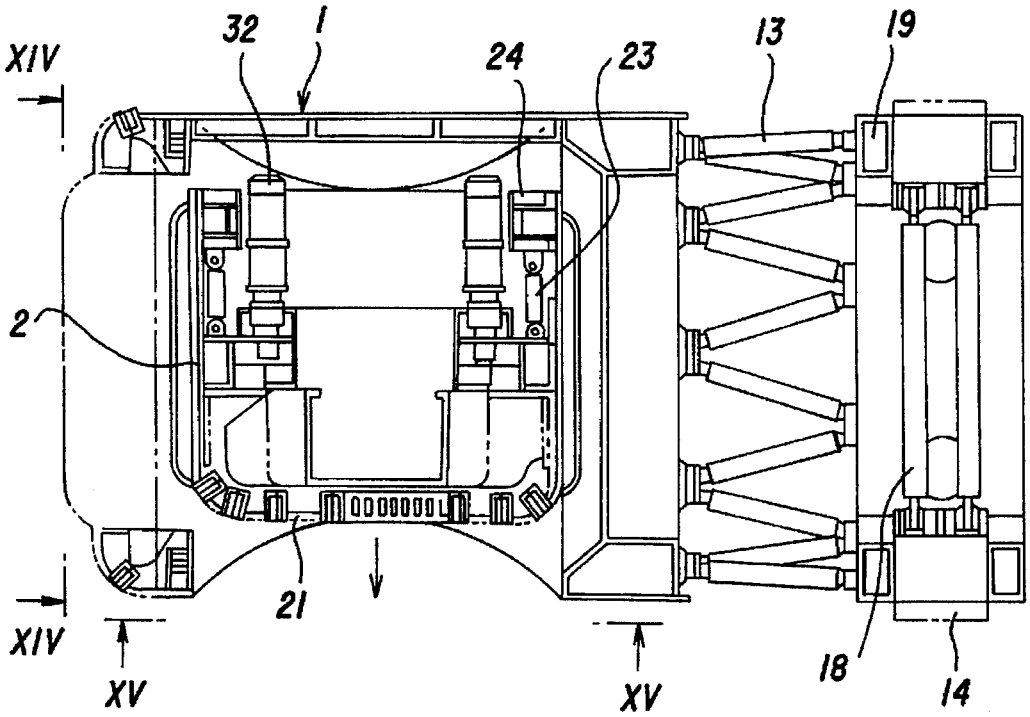
FIG. 13 is a side cross section diagram of the ancillary machine rotated 90 degrees.
Figure 14:
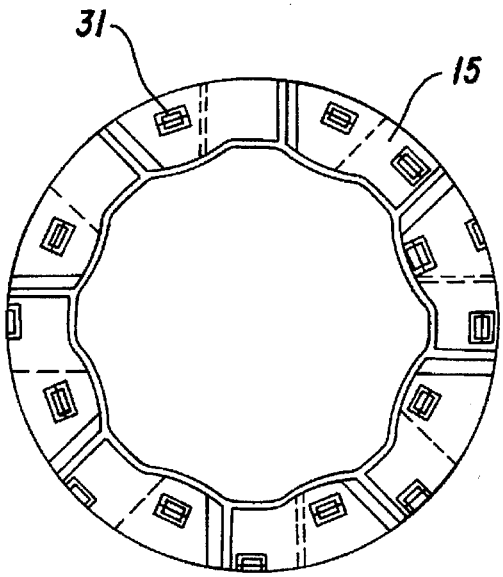
FIG. 14 is a cross section diagram of that portion of FIG. 13 between arrows XIV—XIV.
Figure 15:
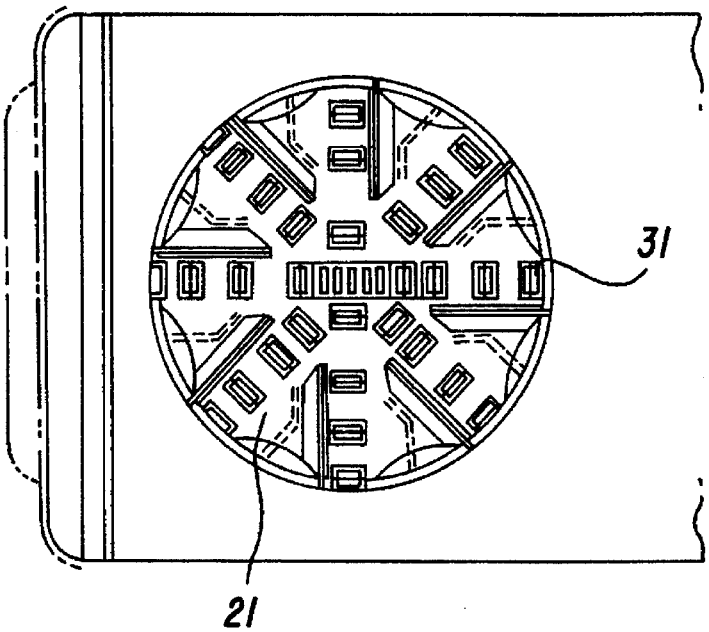
FIG. 15 is a cross section diagram of that portion of FIG. 13 between arrows XV—XV.

Using a winch or a jack, not shown in the diagram, the reaction force is supported on the main machine I to pull back the ancillary machine 2, and separate—the inner cutting disc 21 from the outer cutting ring 15. Next, using a provisional hydraulic jack or other means not shown in the diagram, the pivotable housing 16 mounted inside the main machine 1, is turned 90 degrees. The inner cutting disc 21 is then rotated by the drive source 32, wherein the ancillary machine 2 is separated from the main machine 1. It can then be used to build the ancillary tunnel (FIGS. 13–15).

In this case, the reaction forces received by the rear gripper shoe 24, rear gripper (not shown in the diagram), and rear gripper jack (not shown in the diagram) are used, and the ancillary machine 2 advances forward with the extension of the propulsion jack 23. Note that in the diagrams, 22' is the ancillary machine front gripper.

Figure 17A:
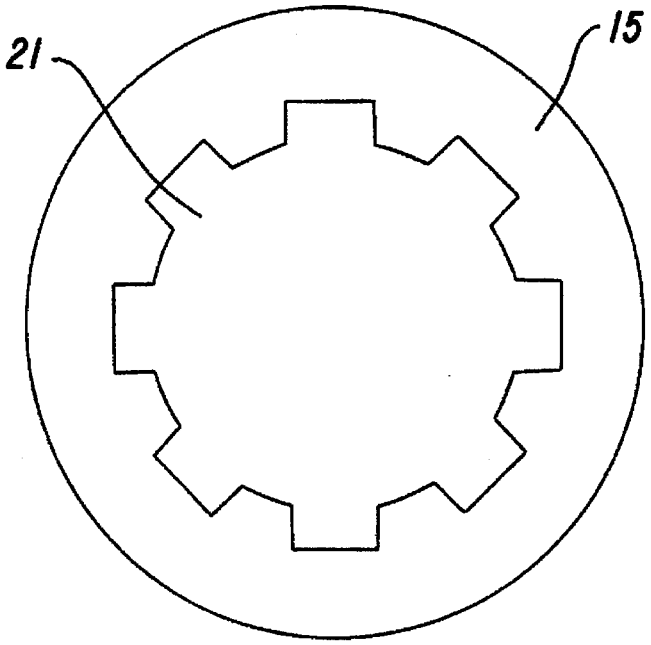
FIG. 17 illustrates different notched configurations.
Figure 17B:
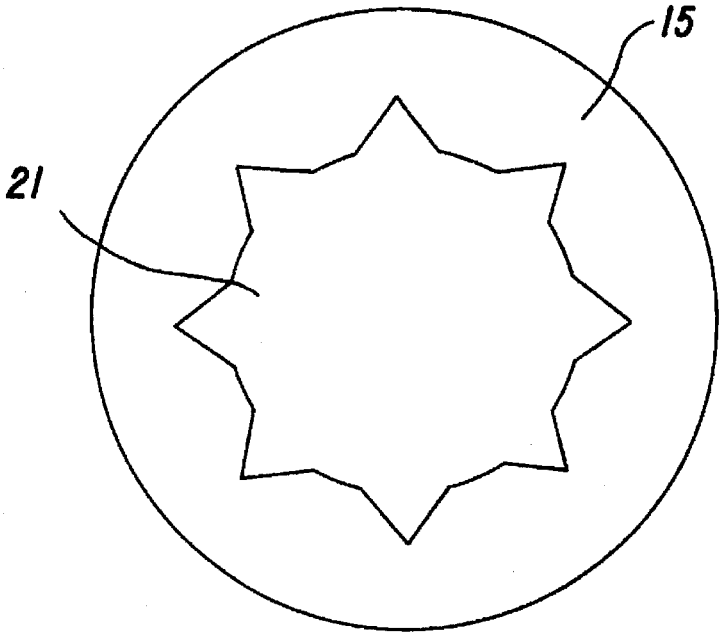

Notches are formed on the inner surface of the outer cutting ring 15 which is attached to the main machine 1 by bearings 33; and similarly, notches are formed on the outer surface of the inner cutting disc 21. Torque is transmitted as the notches mesh. This notched configuration facilitates and shortens the time required for the insertion, withdrawal, and other operations of the inner cutting disc 21 relative to the outer cutting ring 15. As shown in FIG. 17, the notches can be star-shaped or rectangular.

Figure 16:
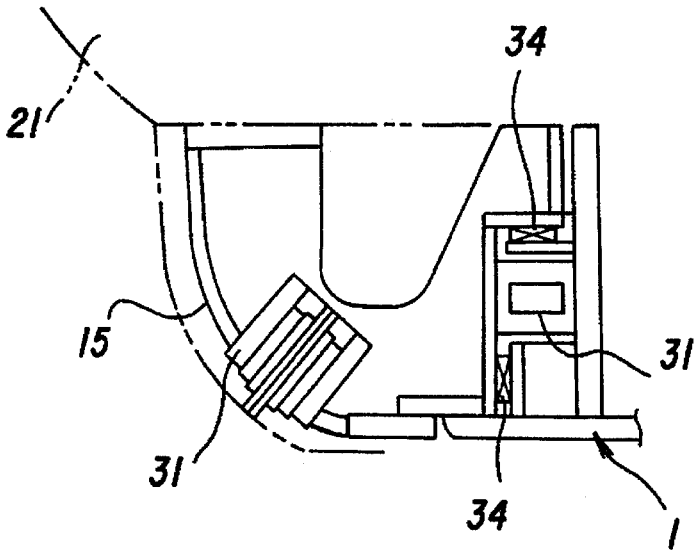
FIG. 16 is an expanded diagram of the bearing portion of the outer cutting ring.

In this configuration, bearings 33 and soil seals 34 are set on the rear face of the outer cutting ring 15 to prevent vibrations and off-centering from the rotation of the outer cutting ring 15. It is also equipped with a mechanism to receive the thrust from the pressure on the front face of the outer cutting ring 15, which combined with the reaction force received from the inner cutting disc 21, receives the entire thrust of the outer cutting ring 15. (FIG. 16).

The turnable tunnel excavator of this invention, as explained above has the following advantages.

The main machine I itself serves a dual purpose as the reaction force device for the excavation of crosscut B, and as the launching pad for the ancillary machine. Hence, the equipment for the actions need not be brought in or removed for each excavation of a crosscut B, effectively shortening the construction period.

This makes the excavator extremely economical, since there are no costs for assembly and disassembly, and operation is safe because handling of dangerous, heavy equipment is reduced.

There is no need, as in the conventional method, to remove part of the concrete wall built temporarily for the main tunnel A in order to excavate a crosscut B, again making the unit more economical.

Centipede-type tunneling in which crosscuts B are positioned on both sides of the main tunnel A, comb-type tunneling in which crosscuts B are positioned on one side only of the main tunnel A, or T-type tunneling in which the ancillary machine 2 is not restored back into the main machine are possible. Operation is economical in all cases since the tunneling direction can be shifted 90 degrees while constructing the main tunnel A without having to draw an arc.

Notches can be molded on the outer perimeter of the inner cutting disc and inner perimeter of the outer cutting ring. This configuration enables a quick and safe transition from the main machine to the ancillary machine by meshing and demeshing the notches. This eliminates the need for keys to anchor the inner cutting disc to the outer cutting ring, and eliminates the need for workers to enter the rear chamber behind the inner cutting disc.

Bearings can be set on the rear face of the outer cutting ring which will prevent vibration and off-centering of the outer excavating ring during excavation. This also facilitates insertion of the inner cutting disc.

Notches can be set on the outer perimeter of the inner cutting disc and inner perimeter of the outer cutting ring, and bits can be positioned on the protruding segments of the notches. This will enable bits to be positioned over the entire face as compared to the donut format.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A main-ancillary tunnel excavator comprising a main machine including a main front cylinder, a main rear cylinder, a main propulsion jack connecting said main front cylinder and said main rear cylinder, and main grippers mounted on said main front cylinder and said main rear cylinder which take the reaction forces at walls excavated by said main machine; a pivotable housing which turns inside said main machine; and an ancillary machine housed inside said pivotable housing and including an ancillary front cylinder, an ancillary rear cylinder, an ancillary propulsion jack connecting said ancillary front cylinder and said ancillary rear cylinder, and ancillary grippers mounted on said ancillary front cylinder and said ancillary rear cylinder which take the reaction forces at the walls excavated by said ancillary machine.

2. A main-ancillary tunnel excavator comprising a main machine including a main front cylinder, a main rear cylinder, a main propulsion jack connecting said main front cylinder and said main rear cylinder, and main grippers mounted on said main front cylinder and said main rear cylinder which take the reaction forces at walls excavated by said main machine; an inner cutting disc and outer cutting ring surrounding said disk positioned on a front face of said excavator; a pivotable housing which turns inside said main machine; and an ancillary machine housed inside said pivotable housing and including an ancillary front cylinder, an ancillary rear cylinder, an ancillary propulsion jack connecting said ancillary front cylinder and said ancillary rear cylinder, and ancillary grippers mounted on said ancillary front cylinder and said ancillary rear cylinder which take the reaction forces at the walls excavated by said ancillary machine; wherein the inner cutting disc of the main machine serves a dual purpose as a cutting disc of the ancillary machine.

3. A main-ancillary tunnel excavator as claimed in claim 1 or claim 2, in which said ancillary grippers interlock into the cylinders of said main machine.

4. A main-ancillary tunnel excavator as claimed in claim 2 wherein the inner cutting disc and said outer cutting ring on the front face of the main machine are integrated by the insertion of keys to enable torque to be transmitted.

5. A main-ancillary tunnel excavator as claimed in claim 1, wherein during launch of the ancillary machine, the reaction force therein is transmitted in order to the pivotable housing, the pivoting shaft of the said housing, and the main machine.

6. A main-ancillary tunnel excavator as claimed in claim 1 or claim 2, in which the pivotable housing of the main machine can turn 90 degrees left or right of the direction of advancement of the main machine.

7. A main-ancillary tunnel excavator comprising a main machine equipped with an inner excavating disc and outer excavating ring on a front face thereof, and an ancillary machine that serves a dual function as the said inner cutting disc; wherein notches on an inner perimeter of the outer cutting ring and on an outer perimeter of the inner cutting disc mesh the two together such that the two cutting units cannot mutually rotate, but are axially detachable.

8. A main-ancillary tunnel excavator as claimed in claim 7 wherein bearings are positioned on a back face of said outer cutting ring.

9. A main-ancillary tunnel excavator as claimed in claim 2 wherein notches are provided on an inner perimeter of the outer cutting ring and on an outer perimeter of the inner cutting disc, said notches meshing the two surfaces together such that the two cutting units cannot mutually rotate but are axially detachable.

10. A method of tunneling comprising the steps of:

excavating a main tunnel with a main tunnel excavator including a front cylinder, a rear cylinder, a propulsion jack connecting said front and rear cylinders, and grippers which take the reaction force at the excavated walls while said tunnel excavator is excavating, providing a pivotable housing turnably mounted in said main tunnel excavator, removably housing an ancillary tunnel excavator inside said pivotable housing, said ancillary tunnel excavator including an ancillary front cylinder, an ancillary rear cylinder, an ancillary propulsion jack connecting said ancillary front cylinder and said ancillary rear cylinder, and ancillary grippers mounted on said ancillary front cylinder and said ancillary rear cylinder which take the reaction forces at the walls excavated by said ancillary tunnel excavator while said ancillary tunnel excavator is excavating, at a position along said main tunnel where a crosscut is desired, turning said pivotable housing to face the position and excavating the crosscut with said ancillary tunnel excavator.

11. A method of excavating as claimed in claim 10 further comprising the steps of:

after excavation of the crosscut, returning said ancillary tunnel excavator into said pivotable housing in said main tunnel excavator, turning said pivotable housing directly away from the position, and excavating another crosscut with said ancillary tunnel excavator.

12. A method of excavating as claimed in claim 10 further comprising the steps of:

after excavation of the crosscut, returning said ancillary tunnel excavator into said pivotable housing in said main tunnel excavator, turning said pivotable housing directly away from the position, further excavating said main tunnel with said main tunnel excavator, at a second position along said main tunnel where another crosscut is desired, turning said pivotable housing to face the second position, and excavating the another crosscut with said ancillary tunnel excavator.

13. A method of tunneling comprising the steps of:

providing a main tunnel excavator including a front cylinder, a rear cylinder, a propulsion jack connecting said front and rear cylinders, an inner cutting disc and outer cutting ring surrounding said disk positioned on a front face of said excavator, a pivotable housing which turns inside said main excavator, and grippers which take the reaction force at the excavated walls while said tunnel excavator is excavating, excavating a main tunnel with said outer cutting ring and said inner cutting disc, removably housing an ancillary tunnel excavator inside said pivotable housing, said ancillary tunnel excavator including an ancillary front cylinder, an ancillary rear cylinder, an ancillary propulsion jack connecting said ancillary front cylinder and said ancillary rear cylinder, and ancillary grippers mounted on said ancillary front cylinder and said ancillary rear cylinder which take the reaction forces at the walls excavated by said ancillary tunnel excavator while said ancillary tunnel excavator is excavating, said inner cutting disc of said main tunnel excavator serving as the cutting disc of said ancillary tunnel excavator, at a position along said main tunnel where a crosscut is desired, turning said pivotable housing to face the position and excavating the crosscut with said inner cutting disc serving as the cutting disc of said ancillary tunnel excavator.

14. A method of excavating as claimed in claim 13 further comprising the steps of:

after excavation of the crosscut, returning said ancillary tunnel excavator into said pivotable housing in said main tunnel excavator, turning said pivotable housing directly away from the position, and excavating another crosscut with said inner cutting disc serving as the cutting disc of said ancillary tunnel excavator.

15. A method of excavating as claimed in claim 13 further comprising the steps of:

after excavation of the crosscut, returning said ancillary tunnel excavator into said pivotable housing in said main tunnel excavator, turning said pivotable housing in line with an axis of said main tunnel excavator, further excavating said main tunnel with said outer cutting ring of said main tunnel excavator and said inner cutting disc, at a second position along said main tunnel where another crosscut is desired, turning said pivotable housing to face the second position, and excavating the another crosscut with said ancillary tunnel excavator.

* * * * *